US011737585B2

(12) United States Patent
Smedley et al.

(10) Patent No.: US 11,737,585 B2
(45) Date of Patent: Aug. 29, 2023

(54) SHELVING SYSTEM AND METHODS

(71) Applicants: Jamie Aaron Smedley, Hudson, OH (US); Gabriel Garduno, Minneapolis, MN (US); Billy Mertz, Cincinnati, OH (US)

(72) Inventors: Jamie Aaron Smedley, Hudson, OH (US); Gabriel Garduno, Minneapolis, MN (US); Billy Mertz, Cincinnati, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 17/858,197

(22) Filed: Jul. 6, 2022

(65) Prior Publication Data

US 2022/0330721 A1 Oct. 20, 2022

Related U.S. Application Data

(63) Continuation of application No. 17/150,345, filed on Jan. 15, 2021, now Pat. No. 11,389,015.
(Continued)

(51) Int. Cl.
*A47F 5/00* (2006.01)
*A47F 5/10* (2006.01)
(Continued)

(52) U.S. Cl.
CPC ..... *A47F 5/005* (2013.01); *A47B 45/00* (2013.01); *A47B 57/588* (2013.01);
(Continued)

(58) Field of Classification Search
CPC ..... A47B 41/06; A47B 45/00; A47B 96/04; A47B 57/58; A47B 57/588; A47B 65/10; A47B 65/15; A47F 5/005; A47F 5/105; A47F 5/16; A47F 2005/165; A47F 3/004; A47F 3/06; A47F 2003/066;
(Continued)

(56) References Cited

U.S. PATENT DOCUMENTS 2,886,182 A 5/1959 Dauman
3,181,703 A 5/1965 Dunham
(Continued)

FOREIGN PATENT DOCUMENTS

CN 105939636 A 9/2016
CN 108477884 A 9/2018
(Continued)

OTHER PUBLICATIONS

Carlson Airflo Merchandising Systems; Vertical Liftback Rack; https://www.carlson-airflo.com/product-catalog/products/vertical-liftback-rack; website first known Jan. 15, 2020 (last visited Apr. 13, 2021).

*Primary Examiner* — Jennifer E. Novosad
(74) *Attorney, Agent, or Firm* — Reinhart Boerner Van Deuren P.C.

(57) ABSTRACT

A racking system and methods of assembling a racking system is provided. The racking system includes one or more adjustably positionable backing walls that may be positioned at different distances from a front end of a corresponding shelf. Dividers may be provided to be positioned adjacent the one or more backing walls to divide a product display zone into separate zones.

17 Claims, 14 Drawing Sheets

Related U.S. Application Data

(60) Provisional application No. 62/965,656, filed on Jan. 24, 2020.

(51) Int. Cl.
*A47F 5/16* (2006.01)
*A47B 45/00* (2006.01)
*A47B 57/58* (2006.01)

(52) U.S. Cl.
CPC ..... *A47F 5/0081* (2013.01); *A47F 5/105* (2013.01); *A47F 5/16* (2013.01); *A47F 2005/165* (2013.01)

(58) Field of Classification Search
CPC .... A47F 5/0018; A47F 5/0043; A47F 5/0062; A47F 2005/0075; A47F 5/0081; A47F 5/10; A47F 5/0025
USPC ..... 211/132.1, 207, 175, 184, 208; 108/60, 108/61
See application file for complete search history.

(56) References Cited

U.S. PATENT DOCUMENTS

| | | | |
|---|---|---|---|
| 3,501,019 | A | 3/1970 | Armstrong et al. |
| 4,476,986 | A | 10/1984 | Robinson |
| 4,600,110 | A | 7/1986 | Timor |
| 4,676,384 | A | 6/1987 | Schäfer |
| 4,716,841 | A | 1/1988 | Suttles |
| 4,768,661 | A | 9/1988 | Pfeifer |
| 4,889,253 | A | 12/1989 | Schmulian et al. |
| 4,938,365 | A | 7/1990 | Conway et al. |
| 5,295,596 | A | 3/1994 | Squitieri |
| 5,464,105 | A | 11/1995 | Mandeltort |
| 5,469,976 | A | 11/1995 | Burchell |
| 5,555,990 | A | 9/1996 | Bechstein |
| 5,803,276 | A | 9/1998 | Vogler |
| 6,041,720 | A | 3/2000 | Hardy |
| 6,142,317 | A | 11/2000 | Meri |
| 6,161,708 | A | 12/2000 | Myler |
| 6,883,671 | B2 | 4/2005 | Rushing |
| 6,886,700 | B2 | 5/2005 | Nagel |
| 6,955,269 | B2 | 10/2005 | Menz |
| 7,163,119 | B2 | 1/2007 | Besselman |
| 7,681,746 | B2 | 3/2010 | Schmidt |
| 7,703,866 | B2 | 4/2010 | Benz et al. |
| 8,104,630 | B2 | 1/2012 | Schneider |
| 9,173,504 | B2 | 11/2015 | Hardy |
| 9,265,358 | B2 | 2/2016 | Hardy |
| D760,519 | S | 7/2016 | Le |
| 9,700,156 | B1 | 7/2017 | Hance et al. |
| 10,111,539 | B2 | 10/2018 | Collette |
| 10,323,414 | B2 | 6/2019 | Haba et al. |
| 10,772,424 | B2 | 9/2020 | Turner |
| 10,869,562 | B1 | 12/2020 | Bryan |
| 10,912,399 | B2 | 2/2021 | Cianchino |
| 11,389,015 | B2 * | 7/2022 | Smedley ..... A47F 5/005 |
| 2002/0187016 | A1 | 12/2002 | Kopperud |
| 2004/0065629 | A1 | 4/2004 | Hunt et al. |
| 2005/0077259 | A1 | 4/2005 | Menz |
| 2005/0133474 | A1 | 6/2005 | Nomoto |
| 2005/0139560 | A1 | 6/2005 | Whiteside et al. |
| 2009/0045707 | A1 | 2/2009 | Gerstner et al. |
| 2012/0111764 | A1 | 5/2012 | Lackey et al. |
| 2012/0298550 | A1 | 11/2012 | Martin et al. |
| 2015/0225122 | A1 | 8/2015 | Jones et al. |
| 2015/0225156 | A1 | 8/2015 | Bruns |
| 2015/0230630 | A1 | 8/2015 | Taylor |
| 2016/0073776 | A1 | 3/2016 | Zeidner et al. |
| 2017/0318985 | A1 | 11/2017 | Collette |
| 2019/0116993 | A1 | 4/2019 | Eizinas et al. |
| 2020/0008588 | A1 | 1/2020 | Cianchino |
| 2021/0227999 | A1 | 7/2021 | Smedley et al. |

FOREIGN PATENT DOCUMENTS

| | | | |
|---|---|---|---|
| EP | 3854257 | A1 | 7/2021 |
| WO | WO 00/48488 | A1 | 8/2000 |
| WO | WO 02/03836 | A1 | 1/2002 |
| WO | WO 2005/021406 | A2 | 3/2005 |

* cited by examiner

SHELVING SYSTEM AND METHODS

CROSS-REFERENCE TO RELATED PATENT APPLICATIONS

This patent application is a continuation of U.S. patent application Ser. No. 17/150,345, filed Jan. 15, 2021, which is now pending. This patent application claims the benefit of U.S. Provisional Patent Application No. 62/965,656, filed Jan. 24, 2020, the entire teachings and disclosure of which are incorporated herein by reference thereto.

FIELD OF THE INVENTION

This invention generally relates to shelving assemblies.

BACKGROUND OF THE INVENTION

Shelving assemblies are used to display retail products. One particular shelving assembly is a slant-back shelving system that provides a slanted back. These shelving assemblies find particular use for displaying produce within a refrigerated case. These shelving assemblies may also be referred to as rack systems.

One issue with these types of these types of shelving assemblies is that if an insufficient amount of product is located on the shelves thereof, the appearance to the consumer is diminished. As such, it is preferred to present the products on the shelving assembly in a "fully stocked" presentation.

However, different retail establishments have different amounts of consumer traffic and thus need to be able to display different amounts of product to meet the demands of the corresponding consumer traffic. Unfortunately, in the past, this required different sized retail establishments to purchase different sized shelving units to provide the desired fully stocked presentation.

BRIEF SUMMARY OF THE INVENTION

Embodiments of the invention provides improvements over the current state of the art. These and other advantages of the invention, as well as additional inventive features, will be apparent from the description of the invention provided herein.

In one embodiment, a rack system including a support frame, one or more shelves and a backing wall is provided.

In one embodiment, a rack system including a support frame, first and second shelves, and a backing wall is provided. The first shelf is mounted to the support frame. The first shelf has a first product support deck extending between a front end and a rear end. The second shelf is mounted to the support frame. The second shelf has a second product support deck. The first and second shelves are vertically spaced with the second shelf being vertically above the first shelf. The backing wall has a wall portion mounted to the first shelf. The wall portion extends vertically between the first and second shelves. Some gap is permitted in some embodiments. The backing wall is adjustably positionable between the front and rear end of the first product support deck to adjust a spacing between the wall portion and the front end of the first product support deck.

In one embodiment, the wall portion extends at an angle of between zero and 35 degrees relative to vertical when the first product support deck is substantially horizontal.

In one embodiment, the angle at which the wall portion is positioned relative to vertical is adjustable.

In one embodiment, the wall portion includes a first panel portion and a second panel portion mounted adjacent the first panel portion. A position of the second panel portion relative to the first panel portion is adjustable to adjust a vertical height of the backing wall.

In one embodiment, the backing wall further includes a pair of opposed supports at opposed ends of the wall portion, the opposed supports maintaining the wall portion in an upright orientation relative to the first product support deck.

In one embodiment, the opposed supports have a bottom surface, the bottom surface of the supports extending at a non-zero, non-perpendicular angle relative to a front face of the wall portion.

In one embodiment, the backing wall includes a front lip positioned forward of the wall portion, a top surface of the front lip being substantially parallel to the first product support deck of the first shelf.

In one embodiment, the backing wall includes at least one mounting hook that has a downward extending portion and a horizontal extending portion; and the product support deck of the first shelf includes a first aperture formed therein, the downward extending portion extending through the first aperture with the forward extending portion extending under the product support deck.

In one embodiment, the backing wall further includes a downward extending alignment post that extends generally parallel to the downward extending portion of the mounting hook. The product support deck includes a second aperture formed therein. The alignment post extending through the second aperture.

In one embodiment, the mounting hook is configured such that the horizontal extending portion extends through the first aperture when mounting the backing wall to the product support deck and then the backing wall is pivoted relative to the product support deck as the downward extending portion is positioned within the first aperture. The pivoting action positions the horizontal extending portion at least partially offset from the aperture.

In one embodiment, the wall portion of the backing wall includes an array of apertures formed therethrough.

In one embodiment, the array of apertures is formed from a first portion of apertures laterally offset from a second portion of apertures. The wall portion has a column of second apertures positioned between the first and second portions. The apertures of the array of apertures have a first diameter. The apertures of the column of second apertures having a second diameter different than the first diameter.

In one embodiment, the wall portion includes a first panel portion and a second panel portion mounted adjacent the first panel portion. A position of the second panel portion relative to the first panel portion is adjustable to adjust a vertical height of the backing wall. The first panel portion includes the column of second apertures. The second panel portion includes at least one positioning stud sized to be received in the apertures of the column of second apertures to adjust the positioning of the second panel portion relative to the first panel portion to adjust the vertical height of the backing wall.

In one embodiment, the array of apertures is formed from a first portion of apertures laterally offset from a second portion of apertures. The wall portion has a column of second apertures positioned between the first and second portions. The apertures of the array of apertures have a first diameter. The apertures of the column of second apertures have a second diameter different than the first diameter.

In one embodiment, the wall portion includes a first panel portion and a second panel portion mounted adjacent the first panel portion. The first panel portion includes a column of mounting apertures. The second panel portion including at least one positioning stud sized to be received in the apertures of the column of mounting apertures to adjust the positioning of the second panel portion relative to the first panel portion to adjust the vertical height of the backing wall.

In one embodiment, the first and second shelves are mounted to the support frame in a cantilevered orientation.

In one embodiment, the support frame is substantially vertically oriented.

In one embodiment, the vertical spacing between the first and second shelves is adjustable.

In one embodiment, the wall portion includes a first panel portion and a second panel portion mounted adjacent the first panel portion. The position of the second panel portion relative to the first panel portion is adjustable to adjust a vertical height of the backing wall.

In one embodiment, the second shelf extends between a front end and a rear end. The front end of the second shelf is positioned rearward of the front end of the first shelf.

In one embodiment, a product display zone above the product support deck of the first shelf is defined by the front end of the first shelf and the wall portion of the backing wall. The product display zone is adjustable by adjusting the position of the wall portion toward or away from the front end of the first shelf.

In one embodiment, a horizontal position of the backing wall relative to the first shelf is adjustable.

In one embodiment, at least one divider is positioned at least in part forward of the backing wall and vertically between the first and second shelves. The divider separates the product display zone into two separate product display zones.

In one embodiment, at least one divider extending at least in part forward of the backing wall and vertically between the first and second shelves.

In one embodiment, the support frame is mountable within a refrigerated case. The support frame is configured to be mounted in a vertical orientation or a canted orientation relative to the refrigerated case.

In one embodiment, a front stop is positioned adjacent the front end of the first shelf. A product display zone is formed between the front stop and the wall portion of the backing wall.

In one embodiment, the wall portion of the backing wall extends at an angle relative to the first product support deck of between ninety and fifty-five degrees.

In one embodiment, the first product support deck extends at an angle relative to horizontal such that the first product support deck slants upward from the front end toward the rear end.

In one embodiment, the support frame includes a hanger arrangement for hanging the support frame.

In one embodiment, a second backing wall having a second wall portion mounted to the second shelf is provided. The second backing wall is adjustably positionable between a front and rear end of the second product support deck to adjust a spacing between the second wall portion and the front end of the second product support deck.

In one embodiment, a divider is positioned laterally between the first and second backing walls.

In one embodiment, the divider has a main divider body and a pair of mounting feet. One mounting foot is positioned forward of the second backing wall and one mounting foot is positioned rearward of the second backing wall.

In one embodiment, the mounting feet laterally overlap with the second backing wall such that the mounting feet form a space therebetween in which an end portion of the second backing wall is positioned.

In one embodiment, the second backing wall has a base having a first depth in the front to back direction. The pair of mounting feet have a spacing in the front to back direction. The spacing is greater than the first depth to allow for front to back adjustment of the position of the second backing wall relative to the support deck between the pair of mounting feet.

In an embodiment, a method of assembling a rack system is provided. The method includes attaching a first shelf to a support frame. The first shelf has a first product support deck extending between a front end and a rear end. The method includes attaching a second shelf to the support frame. The second shelf has a second product support deck. The first and second shelves are vertically spaced with the second shelf being vertically above the first shelf. The method includes mounting a backing wall having a wall portion to the first shelf. The wall portion extends vertically between the first and second shelves. The backing wall is adjustably positionable between the front and rear end of the first product support deck to adjust a spacing between the wall portion and the front end of the first product support deck.

In one method, the backing wall may be mounted to the first shelf in at least a first position and a second position, the first position locating the wall portion closer to the front end than the second position such that a smaller amount of the first support deck is exposed forward of the wall portion in the first position than in the second position. Mounting the backing wall includes mounting the backing wall in the first position.

In one method, the method includes mounting a second backing wall having a second wall portion to the second shelf. The second wall portion extends vertically upward from the second shelf. The second backing wall is adjustably positionable between a front and rear end of the second product support deck to adjust a spacing between the second wall portion and the front end of the second product support deck. The spacing between the front end of the first shelf and the wall portion is different than the spacing between the front end of the second shelf and the second wall portion.

In one embodiment, the method includes mounting a second backing wall having a second wall portion to the second shelf. The second wall portion extends vertically upward from the second shelf. The second backing wall is adjustably positionable between a front and rear end of the second product support deck to adjust a spacing between the second wall portion and the front end of the second product support deck. Spacing between the rear end of the first shelf and the wall portion is different than spacing between the rear end of the second shelf and the second wall portion.

In one method, the method includes mounting a divider to the first product support deck. The divider extends forward of the backing wall.

In on method, the method includes mounting a second backing wall having a second wall portion to the second shelf. The second wall portion extends vertically upward from the second shelf. The second backing wall is adjustably positionable between a front and rear end of the second product support deck to adjust a spacing between the second wall portion and the front end of the second product support deck. The method includes mounting a divider to the first product support deck. The divider extends forward of the backing wall and the second backing wall. The divider is positioned laterally between the first and second backing walls.

In one method, the divider includes a pair of mounting feet. Mounting the divider includes locating one mounting foot forward of the backing wall and locating one mounting foot rearward of the backing wall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
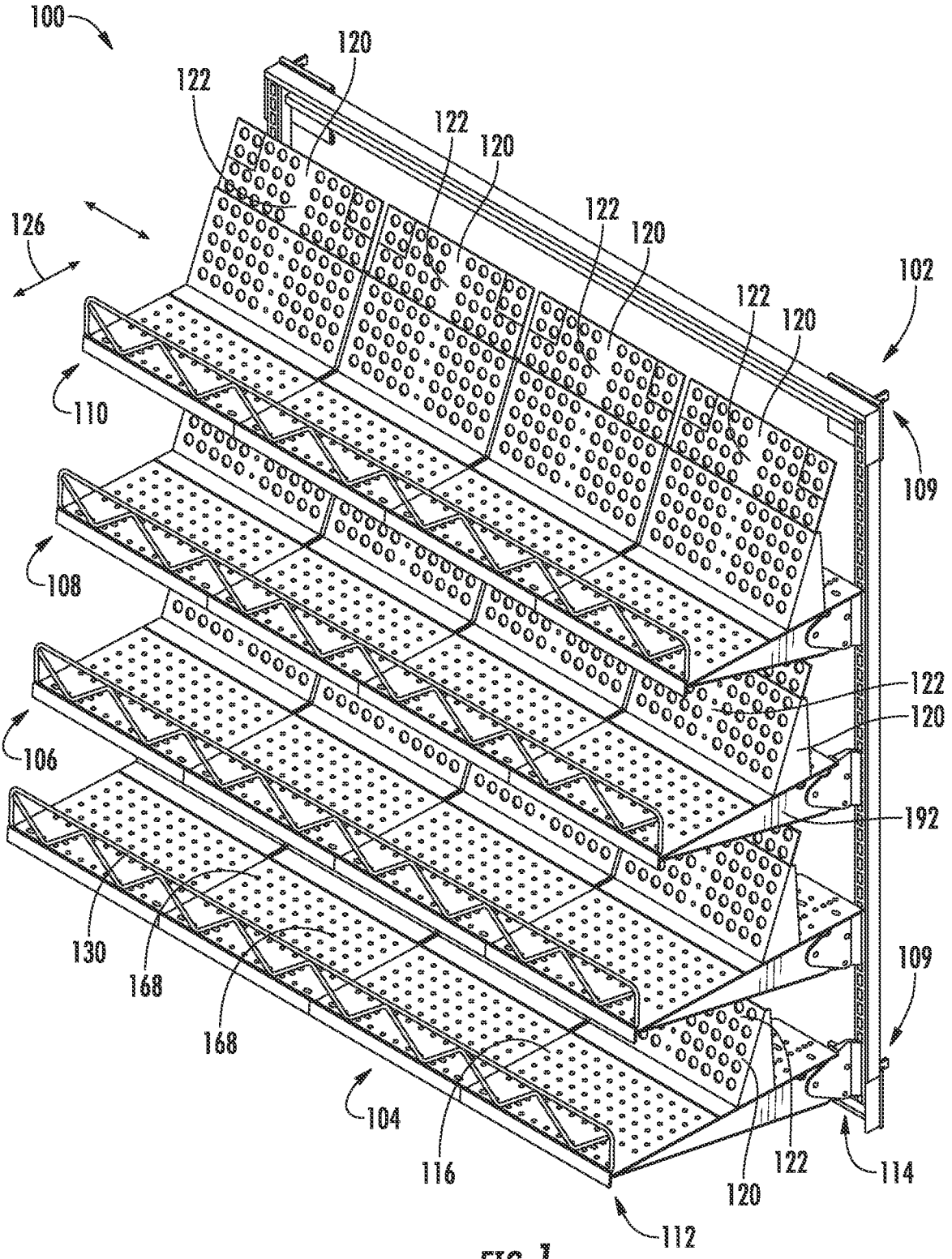
FIG. 1 is a perspective illustration of an embodiment of a rack system according to the application.
Figure 12:
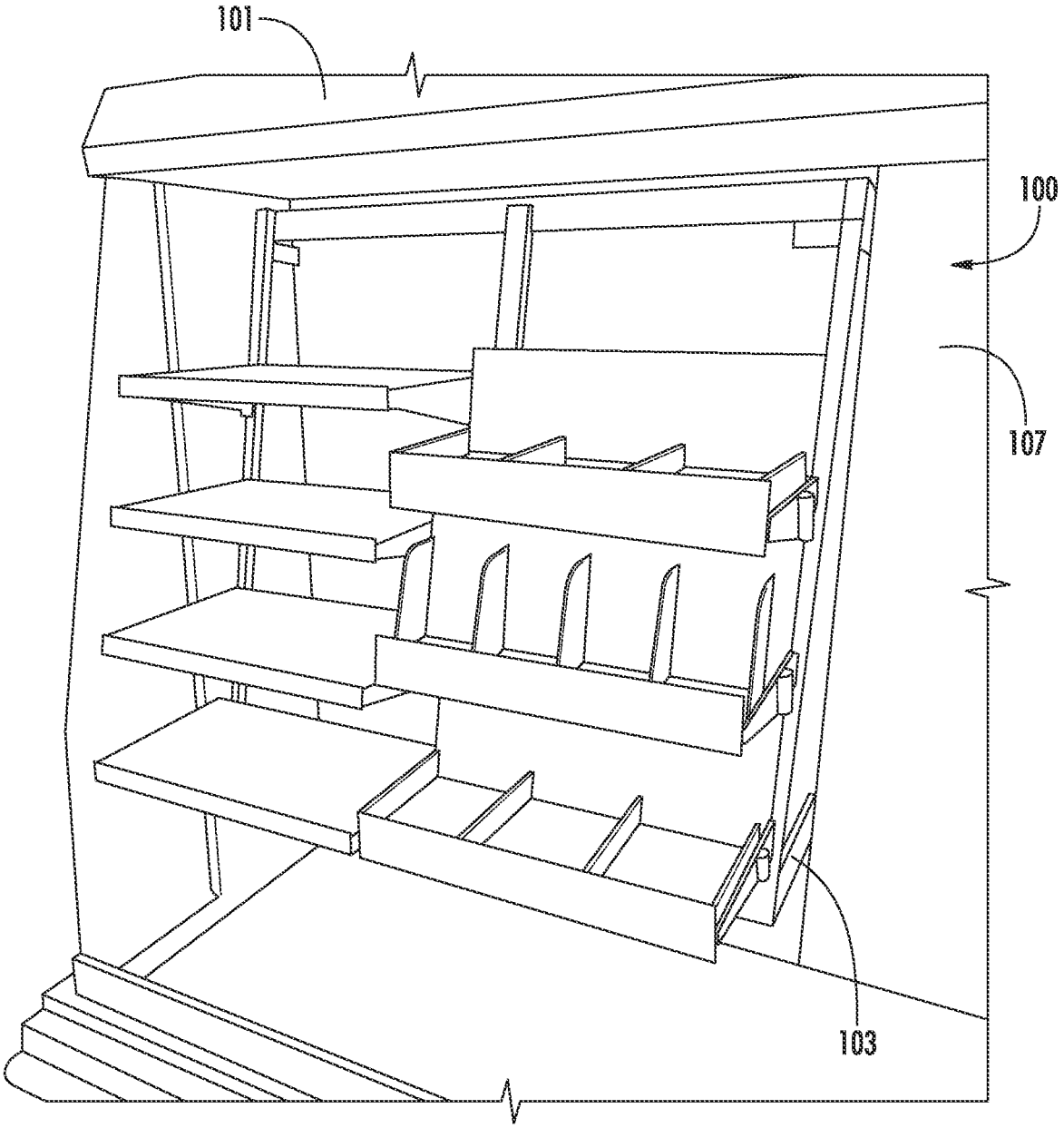
FIG. 12 is a perspective illustration of the rack system of FIG. 1 used in a refrigerated case.

Turning now to the figures, FIG. 1 illustrates a racking system 100 for displaying merchandise. The racking system 100 finds particular use for displaying produce and even more particular use in displaying produce within a refrigerated case 101 (see FIG. 12). The racking system 100 is configurable to tailor the system for displaying varying amounts of product while maintaining the appearance that the racking system 100 is fully stocked with product.

The racking system 100 includes a support frame 102 that supports a plurality of shelves 104, 106, 108, 110 operably mounted thereto. The shelves 104, 106, 108, 110 are vertically spaced apart. While four shelves are illustrated more or fewer shelves may be incorporated into other racking systems.

Figure 2:
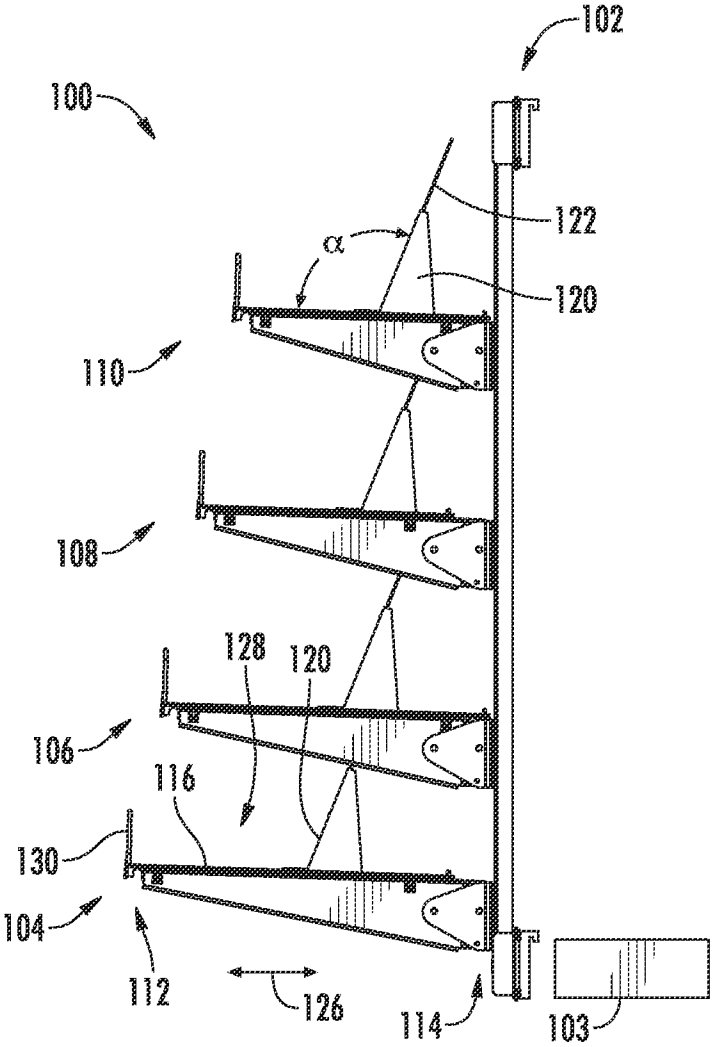
FIG. 2 is a side view of the rack system of FIG. 1.

The shelves 104, 106, 108, 110 are substantially identical except for their front to back depth (e.g. depth between a front end 112 and a rear end 114 as illustrated with reference bottom most shelf 104 in FIG. 2).

The support fame 102 may be mounted in a substantially vertical orientation or in a canted orientation. When mounting in a canted orientation, a spacer bracket 103 (see FIG. 2) may be provided that will push the bottom end of the support frame 102 outward away from any wall to which the support frame 102 is mounted, e.g. a wall 107 of the refrigerated case of FIG. 12 in front of which the racking system 100 is mounted. The spacer bracket 103 is not in use in FIG. 2.

The support frame 102 can include mounting features for mounting. In the illustrated embodiment, the mounting features are in the form of hangers 109. Other embodiments could use pegs, fasteners, etc.

In this embodiment, the shelves 104, 106, 108, 110 are mounted to the support frame 102 in a cantilevered orientation. Optionally, the shelves 104, 106, 108, 110 are vertically adjustable relative to the support frame 102. This allows for adjusting the vertical spacing therebetween to better tailor the racking system for the various products being displayed.

Each shelf 104, 106, 108, 110 has a product support deck (see e.g. product support deck 116 of shelf 104) extending between the front end and rear end of the corresponding shelf. Preferably, the product support deck 116 includes a plurality of apertures 168 formed therethrough.

The product support decks 116 may be mounted such that they slant upward when moving in a front to rear direction, substantially horizontal or with a slight downward slant when moving in the front to rear direction.

To provide for reconfiguration of the racking system 100, a plurality of backing walls 120 are provided. In the illustrated configuration, each shelf 104, 106, 108, 110 includes a plurality of backing walls 120 mounted thereon. In other embodiments, a single backing wall 120 having a width substantially equal to the width of the shelf 104, 106, 108, 110 may be provided.

As the backing walls are generally identical, backing walls 120 on the bottom shelf 104 will be described. The backing wall 120, and particularly a wall portion 122 thereof, extend vertically upward from support deck 116.

The backing walls 120 are adjustably positionable between the front end 112 and rear end 114 of the shelves as illustrated by arrow 126. By adjusting the front to back positioning of the backing walls 120 (e.g. toward or away from the front or rear ends 112, 114), a product display zone 128 above the support deck 116 defined between the front end 112 (and particularly front stop 130) and backing wall 120 (and particularly wall portion 120) can be adjusted.

This allows the product display zone 128 to be tailored to the particular amount of merchandise that will typically be displayed on the particular shelf. This finds particular use for low-volume retailers that want their shelves to appear fully stocked without a large volume of product on the showroom floor. For example, the backing wall 120 can be positioned closer to the front end 112 to reduce the size of the product display zone 128 such that less than the full possible product display zone 128 is exposed.

With reference to shelf 110 and the corresponding backing wall 120, in a preferred embodiment, the wall portion 122 extends at an angle α of between about 90 degrees and 135 degrees (e.g. about 0 degrees and 45 degrees from perfectly vertical when the shelf is horizontal) relative to the product support deck 116. In a preferred, but optional embodiment, the angle α is adjustable.

Figure 4:
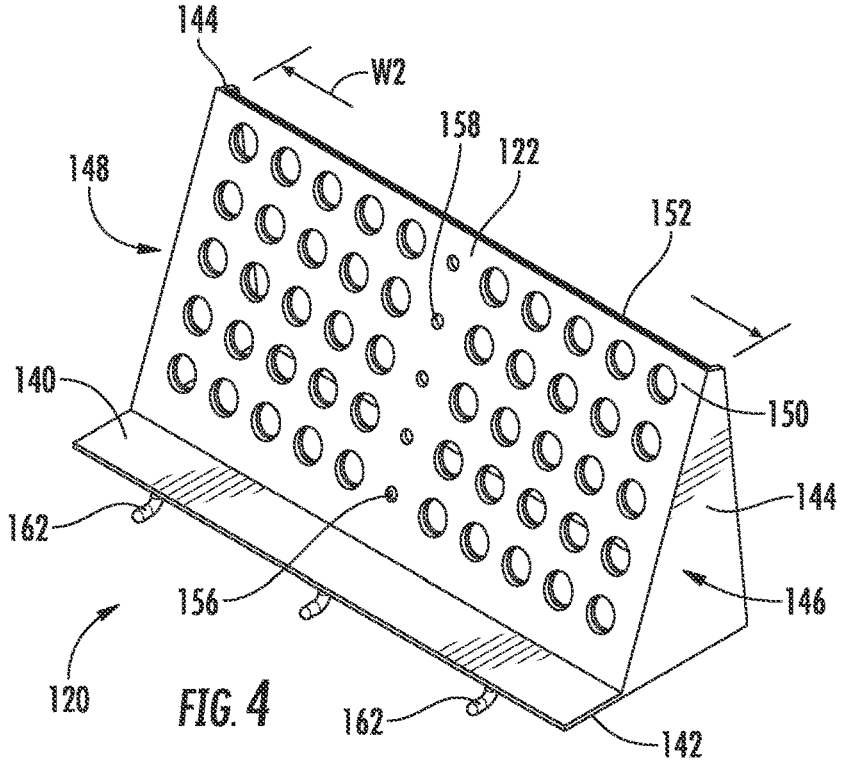
FIG. 4 is a perspective view of a backing wall used in the rack system of FIG. 1 in a short configuration.

With reference to FIG. 4, a backing wall 120 is illustrated. The backing wall 120 includes a base 140 that defines a bottom 142 that sits on the product support deck 116 when mounted to shelf 104.

A pair of opposed supports 144 at opposed ends 146, 148 of the wall portion 122. The supports 144 help support the wall portion 122 in an upright position. As used herein, "upright" shall include orientations having a vertical component to its orientation and does not require being perfectly vertically oriented.

Figure 5:
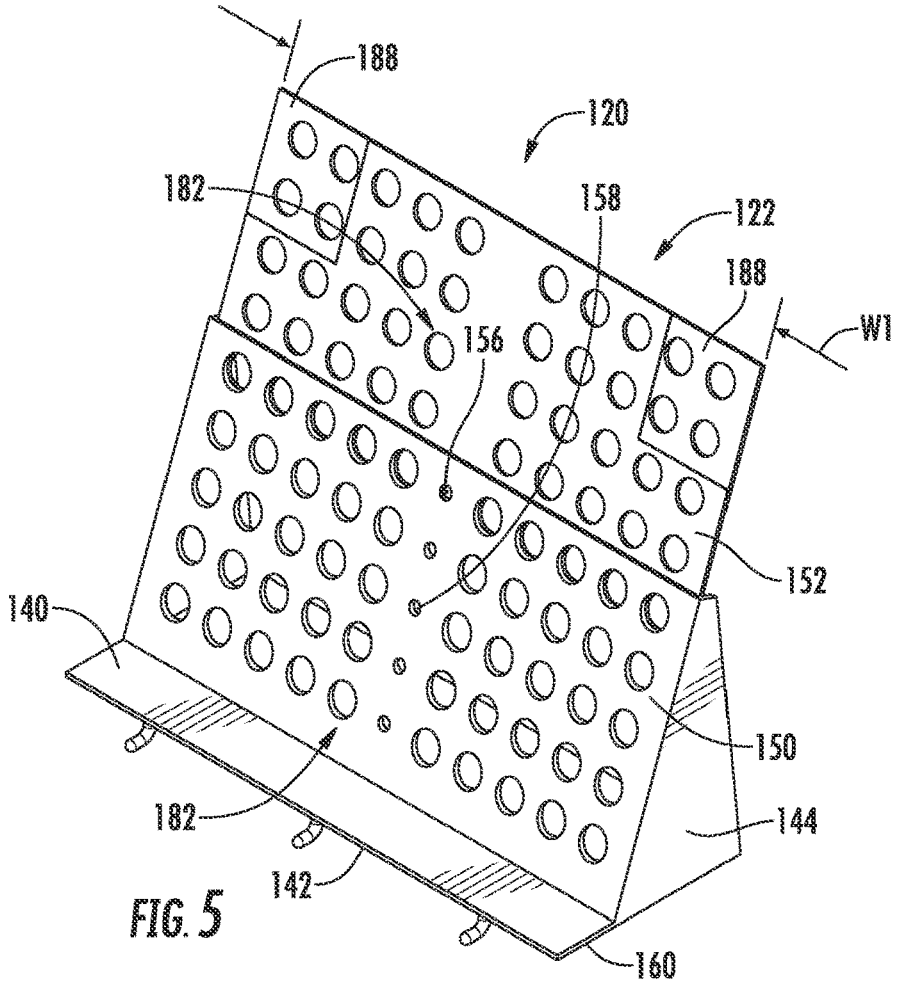
FIG. 5 is a perspective view of the backing wall of FIG. 4 in a tall configuration.

With reference to FIG. 5, the wall portion 122 can be formed from a plurality of panel portions 150, 152. Panel portion 150 is attached to and extends laterally between supports 144. Panel portion 152 is adjustably positionable relative to the first panel portion 152 to adjust a vertical height H1 of the backing wall 120, represented by arrow 154.

In the illustrated embodiment (see also FIG. 9), an attachment arrangement is provided between the panel portions 150, 152. In this embodiment, the attachment arrangement is provided by a forward projecting stud in the form of attachment projection 156 extending forward from a front of panel portion 152 that cooperates with a plurality of apertures 158 formed through panel portion 150. The plurality of apertures 158 are formed in a column and are vertically spaced. As such, the height H1 of the backing wall 120 depends on which aperture in which the attachment projection 156 engages.

Figure 9:
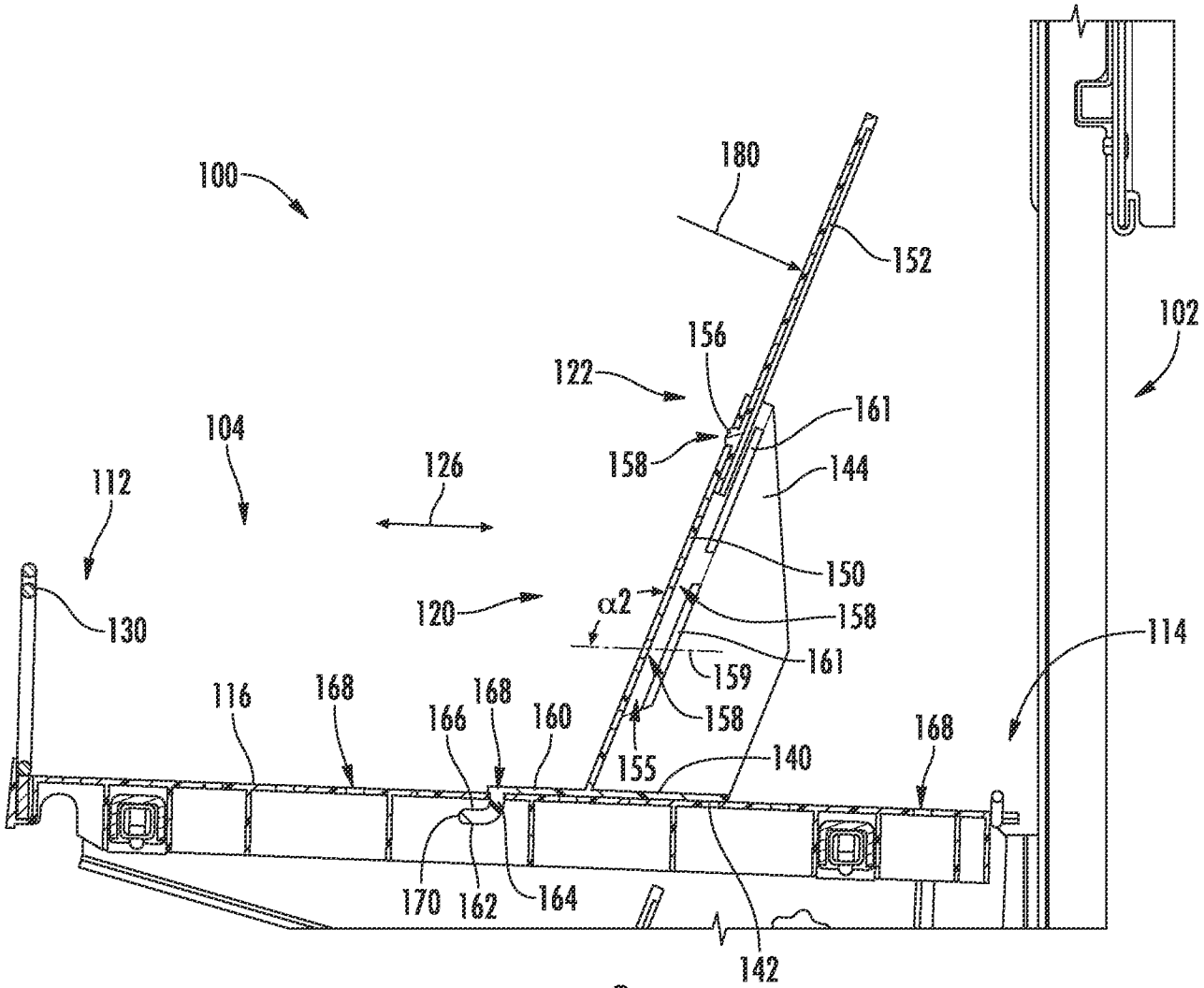
FIG. 9 is a partial cross-sectional illustration of a shelf of the rack system of FIG. 1.

With reference to FIG. 9, in some embodiments, the apertures 158 have a central axis 159 extending through panel portion 150 that is not perpendicular to the front surface thereof. In this embodiment, axis 159 extends at a non-perpendicular angle α2 relative to the front surface of panel portion 150. Angle α2 may be, in some embodiments, between zero (0) degrees and 20 degrees. More preferably, angle α2 is at least five (5) degrees. The angle α2 helps secure attachment projection 156 within the aperture 158.

Stud 156 may have an enlarged head that is sized larger than the diameter of aperture 158 to further improve securement.

Figure 6:
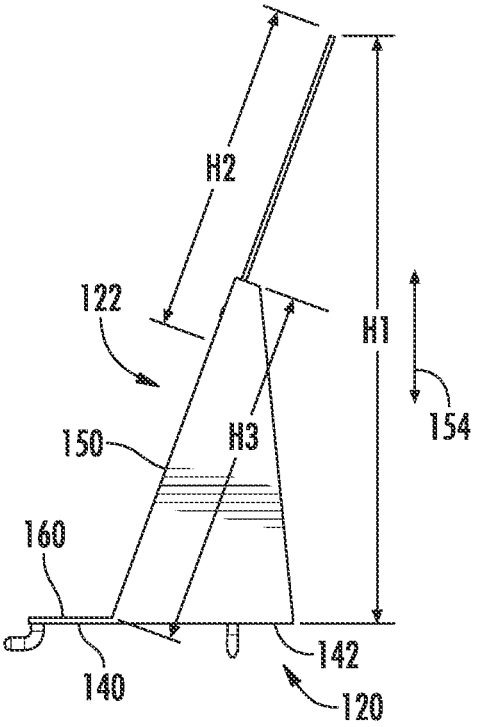
FIG. 6 is a side view of the backing wall of FIG. 4 in the tall configuration.

With additional reference to FIG. 6, the height H2 of panel portion 152 is less than or equal to the height H3 of panel portion 150 such that panel portion 152 can stowed behind panel portion 150 when the backing wall 120 is in its shortest configuration, e.g. as illustrated in FIG. 4. It is noted that attachment projection 156 is used to secure panel portion 152 to panel portion 150 even in this shortest configuration illustrated in FIG. 4. FIG. 5 illustrates the backing wall 120 in its tallest configuration.

Further, width W1 of panel portion 152 is smaller than the width W2 formed between the opposed supports 144. Again, this facilitates stowing the panel portion 152 when the additional height provided thereby is not needed.

Figure 10:
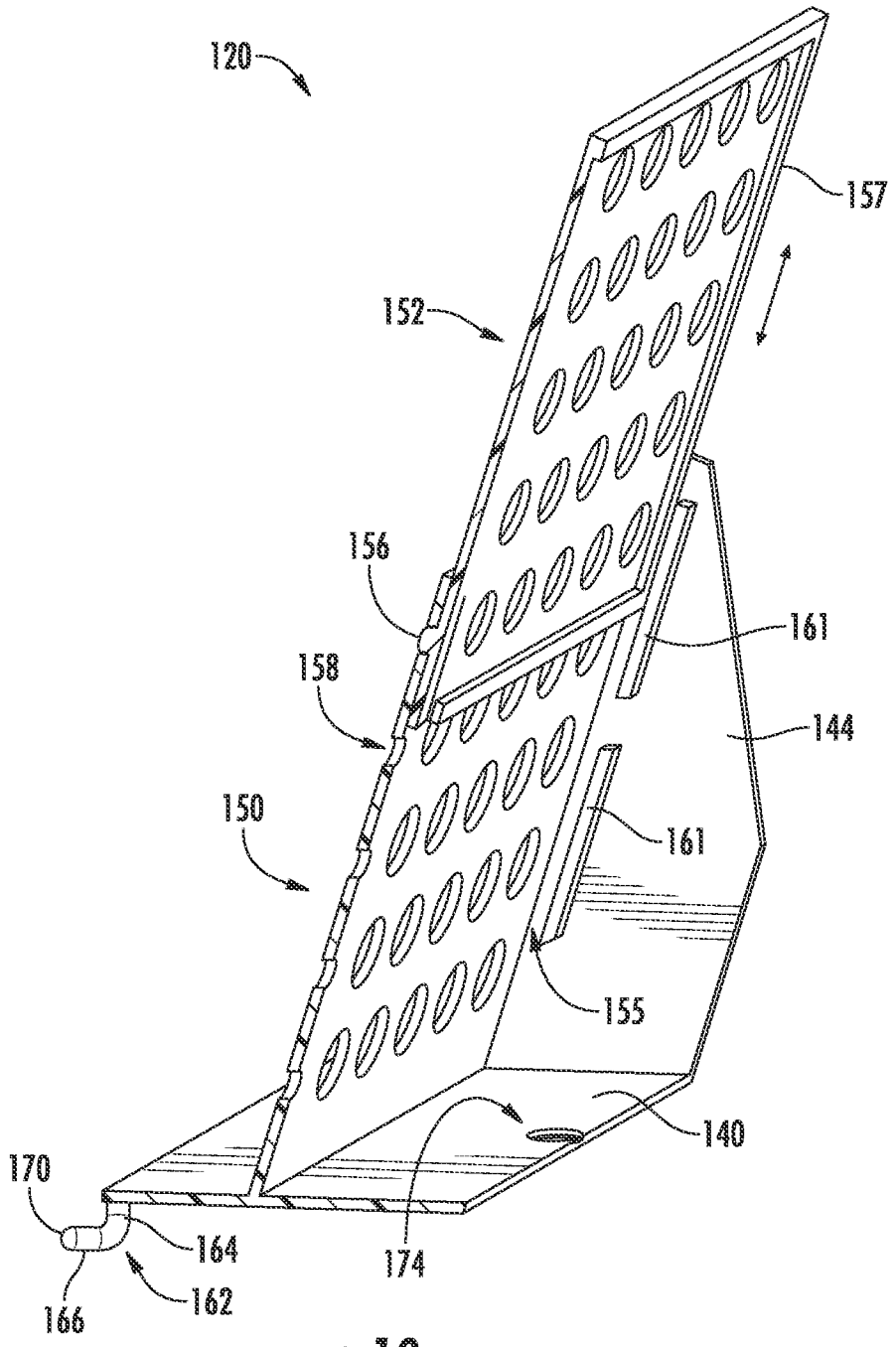
FIG. 10 is a perspective and cross-sectional illustration of the backing wall of FIG. 4 in the tall configuration.
Figure 11:
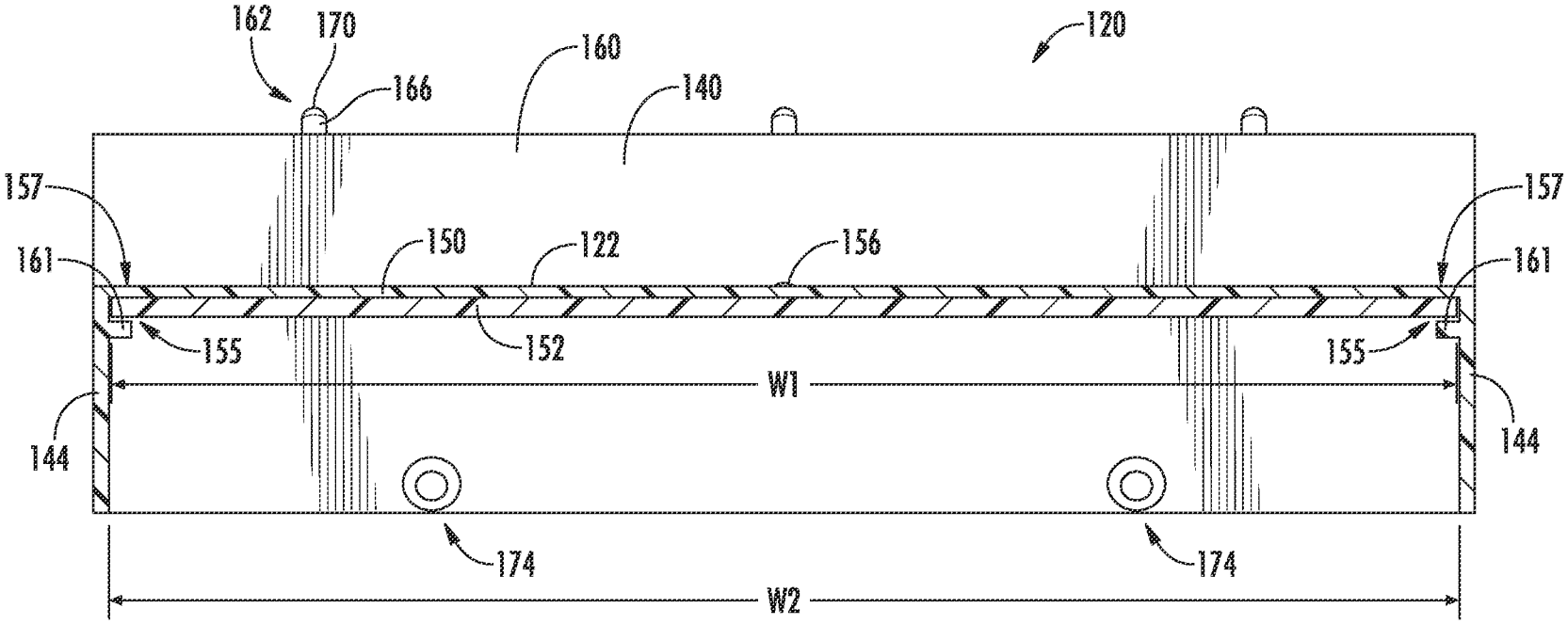
FIG. 11 is a top view of the backing wall of FIG. 4.

With reference to FIGS. 10 and 11, the backing wall 120 defines mounting channels 155 in which the opposed ends 157 of panel portion 152 are received. The panel portion 152 is slideable within the channels 155 when adjusting the position of panel portion 152 relative to panel portion 150.

Figure 17:
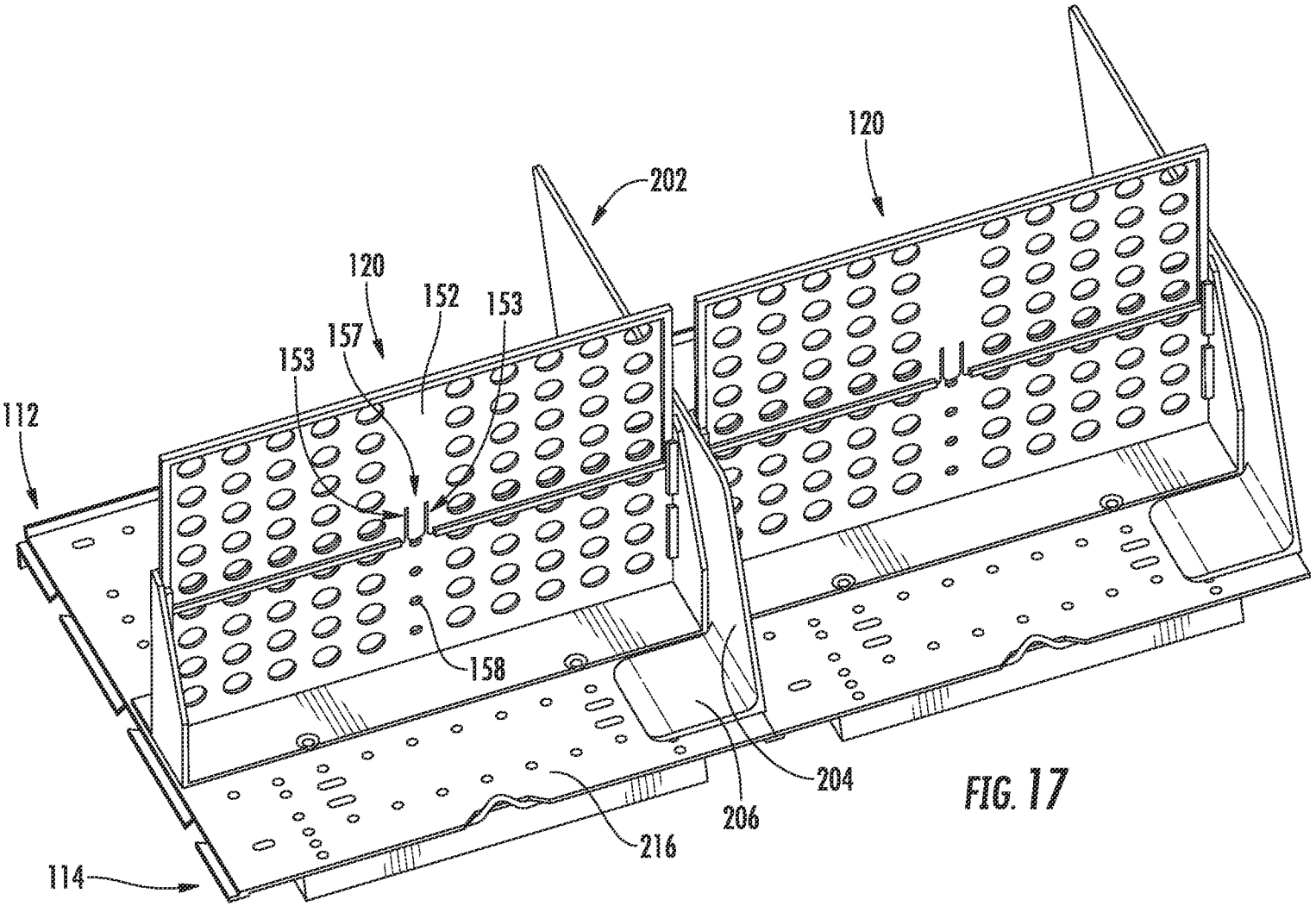
FIG. 17 is a rear view of FIG. 16.

Panel portion 152 has an outer rim that has a greater thickness than the rest of the panel portion 152. This rim provides increased strength. The thickness is configured for easy sliding motion of the panel portion 152 within channels 155. As illustrated in FIG. 17, the outer rim extends substantially around the entire periphery of panel portion 152, except at tab region 157.

In this embodiment, the channels are formed by laterally inward extending flanges 161 that extend inward from inner surfaces of opposed supports 144. The flanges 161 provide support to the rear of the panel portion 152 and prevent attachment projection 156 from inadvertently disengaging from the desired aperture 158.

In some embodiments, panel portion 152 is flexible such that when the height is desired to be adjusted, the user can flex the middle region of panel portion 152 so that projection 156 does not engage apertures 158. When in the desire position relative to panel portion 150, the user can release the middle region and engage projection 156 with the corresponding aperture 158. The slanted axis 159 helps secure projection 156 in engagement with aperture 158.

In this embodiment, base 140 extends forward of the front surface of wall portion 122 and particularly panel portion 150 forming a front lip 160. In other embodiments, the front lip 160 need not be included. In a preferred embodiment, the top surface of the front lip 160 is parallel to the product support deck 116 of the shelf on which the backing wall 120 is mounted.

Figure 7:
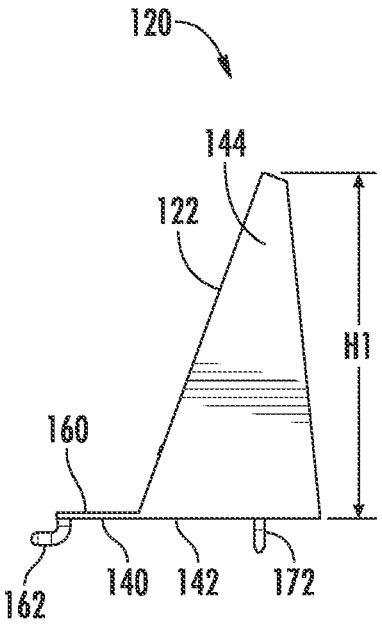
FIG. 7 is a side view of the backing wall of FIG. 4 in the short configuration.
Figure 8:
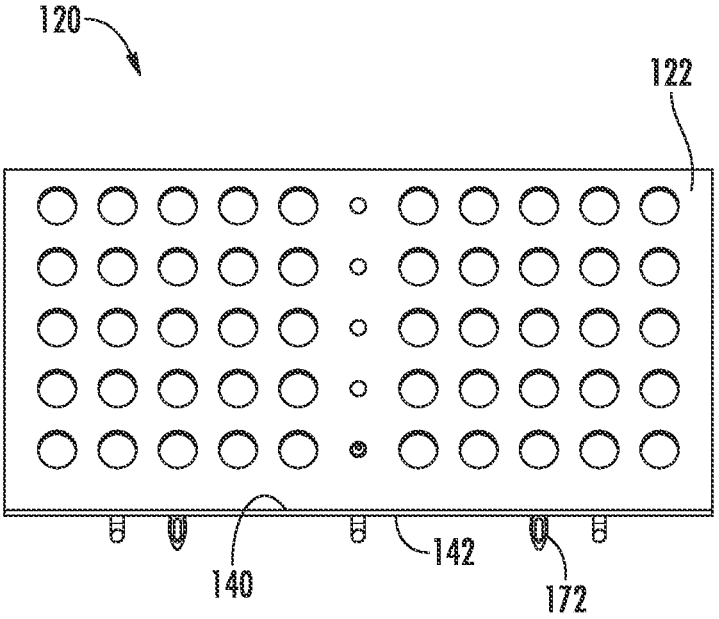
FIG. 8 is a front view of the backing wall of FIG. 4.

With reference to FIGS. 7 and 9, the backing wall 120 includes a plurality of mounting hooks 162 for securing the backing wall 120 to the corresponding shelf and particularly the product support deck thereof. Mounting hook 162 includes a downward extending portion 164 and horizontally extending portion 166. In this embodiment, horizontally extending portion 166 extends in a forward direction relative to downward extending portion 164.

The downward extending portion 164 is generally perpendicular to the bottom of base 140 as well as product support deck 116. However, this is not required. The downward extending portion 164 extends through apertures 168 formed through product support deck 116. The horizontally extending portion 166 extends outward from the downward extending portion 164 and under the product support deck 116.

Preferably, the horizontally extending portion 166 extends a sufficient distance from the downward extending portion 164 such that at least a portion of the horizontally extending portion 166 is offset from aperture 168 when in a mounted state. This is illustrated in FIG. 9 as distal end 170 of horizontally extending portion 166 is offset from aperture 168 and is positioned under a portion of product support deck 116.

With reference to FIG. 7, a downward extending alignment post 172 may be provided to further secure the backing wall 120 to the shelf. With additional reference to FIGS. 10 and 11, the base 140 may include one or more apertures 174 through which the alignment post 172 may extend. This is particularly useful if the alignment post 172 is in the form of a push pin that provides some engagement with the support deck 116 when inserted through corresponding holes 168 thereof when mounting backing wall 120 thereto.

Push pin 172 may have enlarged head sized larger than apertures 168 to provide increased securement. Alternatively, push pin 172 could be sized larger than apertures 168 to provide a press fit engagement.

To mount the backing wall 120 to the shelf 116, with reference to FIG. 9, the distal end of the mounting hook 162 is inserted through the corresponding aperture 168. The backing wall 120 is then rotated as represented by arrow 176 as the mounting hook 162 is progressively inserted through aperture 168. Once the bottom 142 of the base is resting on the top of product support deck 116, the optional push pin may be inserted through aperture 174 (FIGS. 10 and 11—pin not shown).

Preferably horizontally extending portion 166 extends forward, e.g. towards front end 112 of shelf 104. As such, if product pushes against the front surface of wall portion 122 applying a rearward directed force (see e.g. arrow 180 in FIG. 9), the forward extending portion 166 will push against the bottom of the product support deck 116. Thus, the horizontally extending portion 166 should be sized such that the horizontally extending portion 166 is, at least in part, offset from aperture 168 when mounted.

Due to the inclusion of a plurality of apertures 168 spaced both front to back as well as side to side in the product support deck 116, the position of the backing wall 120 can be both adjusted front-to-back as well as side-to-side relative to the shelf.

Because the racking system 100 finds particular use in refrigerated cases, the backing walls 120 include a plurality of apertures 182 formed therein. The apertures 182 allow cooled air or mist to pass therethrough to allow for proper climate control In this embodiment, the apertures 182 are arranged in two separate arrays that are separated by the column of apertures 158 for securing the first and second panel portions 150, 152. In this embodiment, the apertures 182 have a larger diameter than the diameter of apertures 158. However, this is not necessary.

Further, it is desired that the pattern of the apertures 182 is such that the pattern is consistent when transitioning between panel portion 150 and 152 so that it reduces the visual appearance that multiple panel portions are used. As illustrated in FIG. 5, the incremental vertical adjustability of panel portion 152 relative to panel portion 150 is directly correlated to the vertical spacing of the horizontal rows formed by apertures 182 (e.g. apertures 158 directly align with corresponding rows formed by apertures 182).

The backing wall 120 may be adjustable between a vertical height H1 of between 5 and 15 inches and preferably between 6 and 10 inches. The backing wall 120 are preferably configured such that they extend vertically between two vertically adjacent shelves at least 90 percent of the spacing between the vertically adjacent shelves (e.g. the vertical spacing between shelves 104 and 106).

Figure 3:
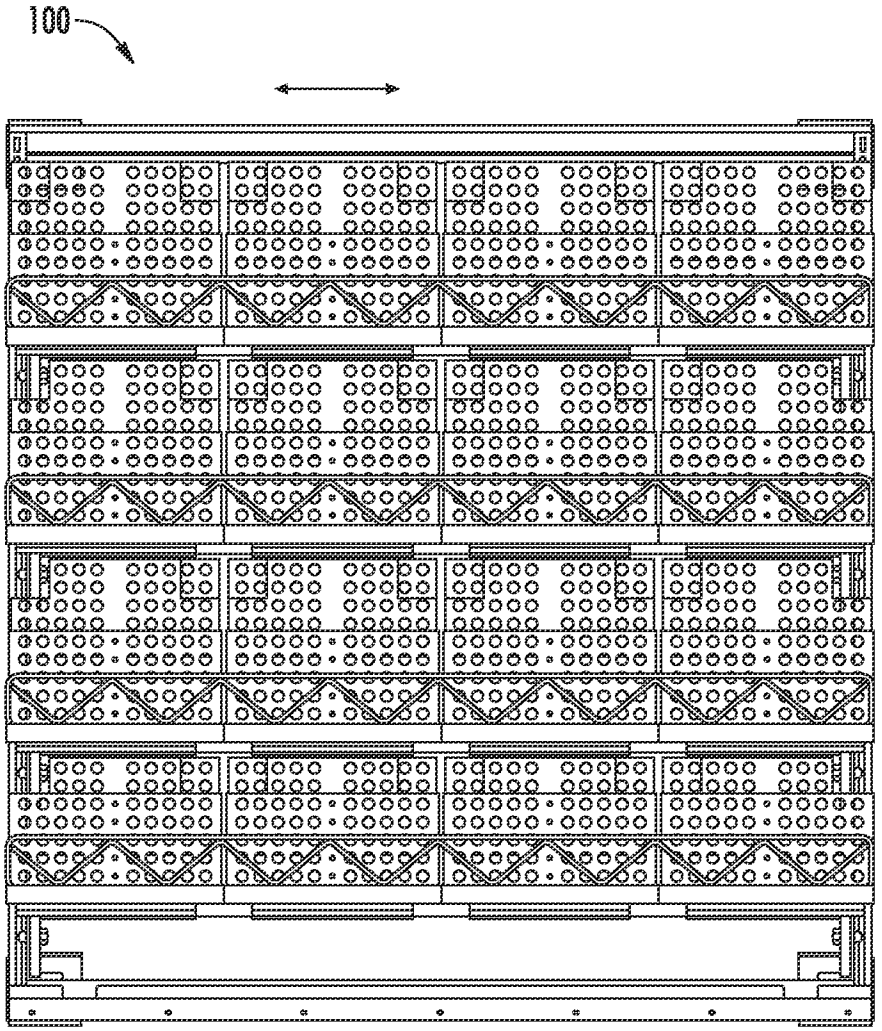
FIG. 3 is a front view of the rack system of FIG. 1.
Figure 13:
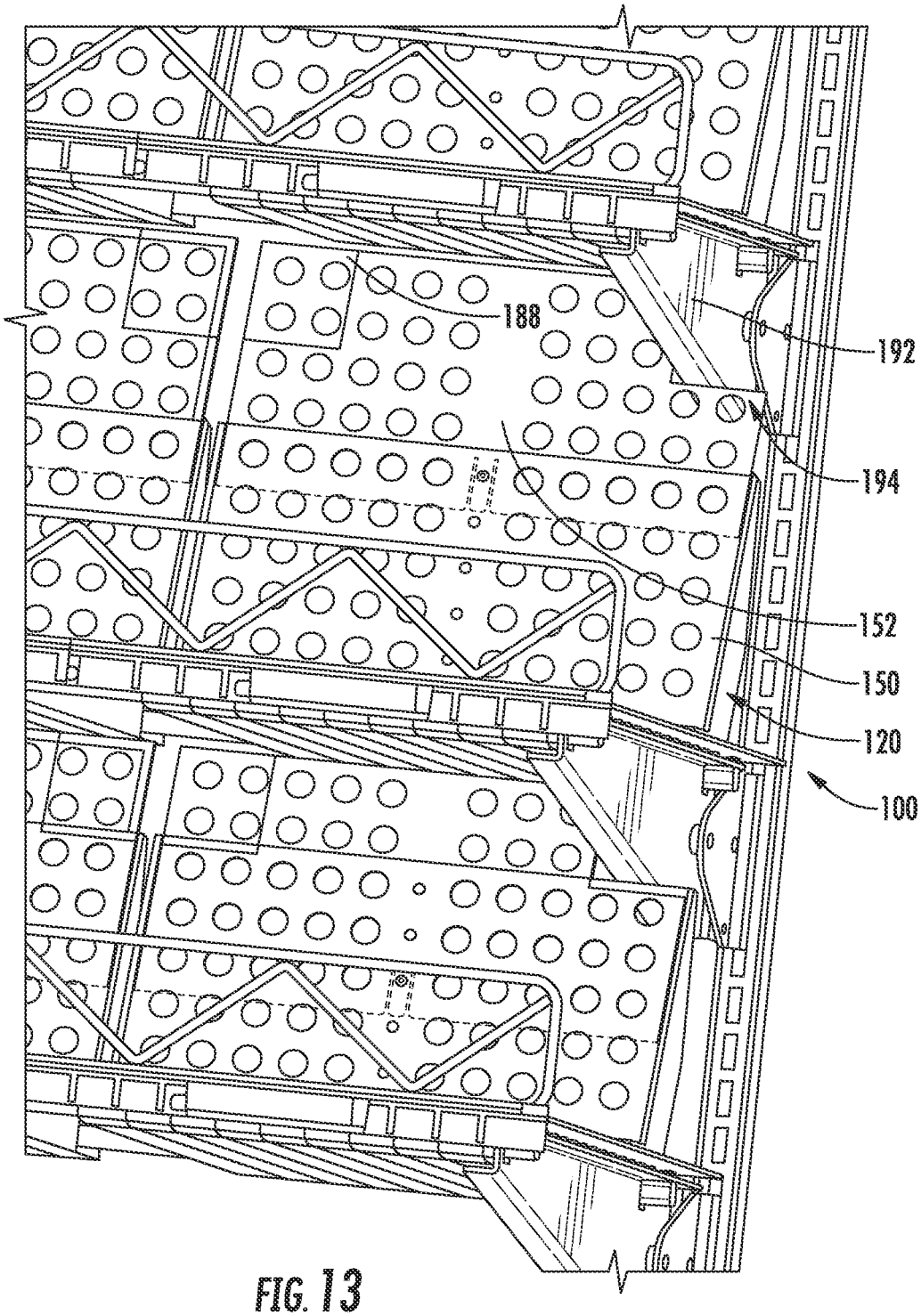
FIG. 13 is an enlarged partial illustration of the rack system of FIG. 1.
Figure 14:
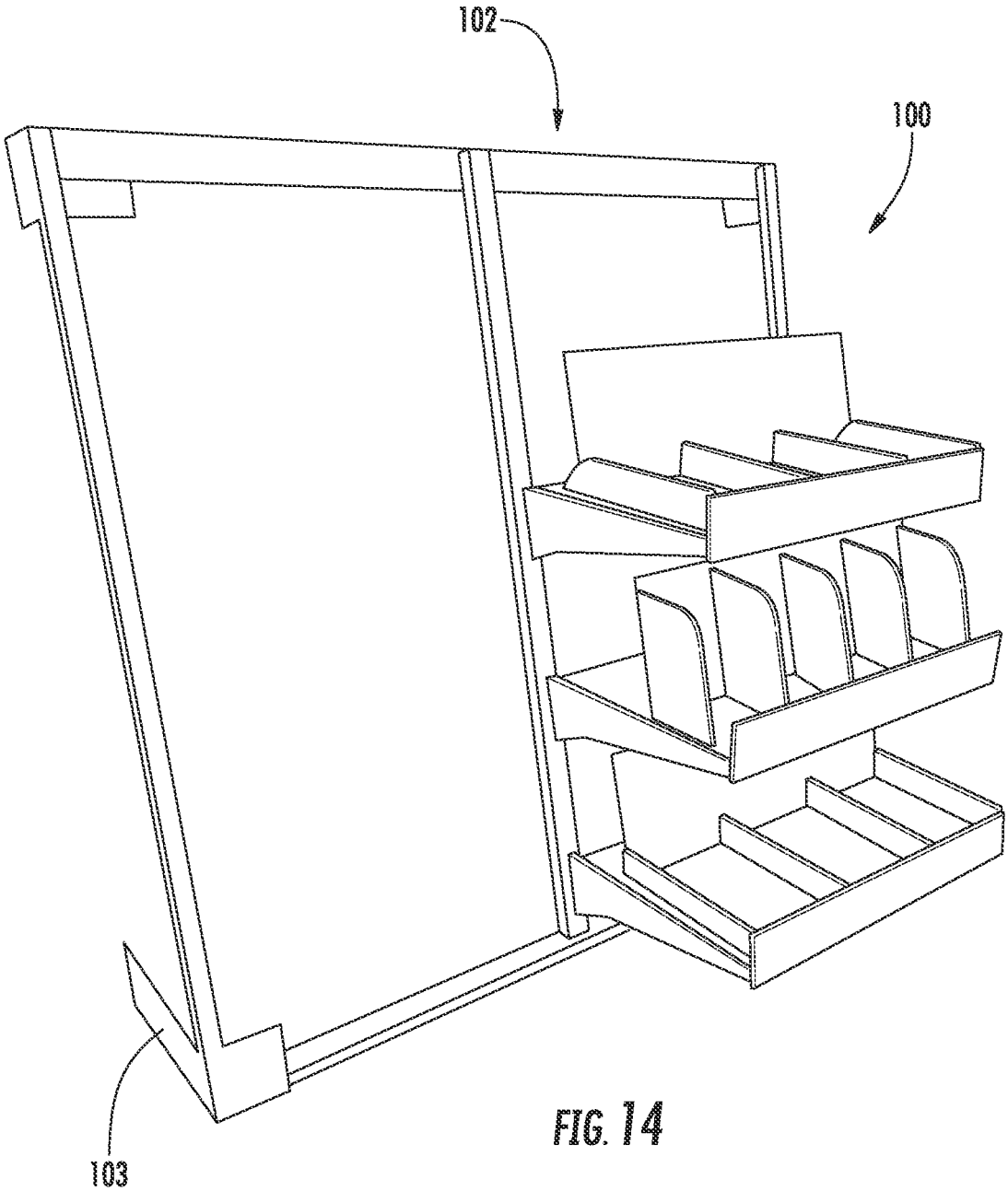
FIG. 14 is a partial perspective illustration of a rack system using dividers.

With reference to FIGS. 5 and 13, panel portion 152 includes knockout regions 188 that are designed to be easily removed from the remainder of the panel portion 152 to accommodate shelf brackets 192 that support the product support deck of the shelf vertically above the corresponding backing wall. For example, the knockout regions 188 could be bound by perforations, scores, creases, etc. to differentiate them from the remainder of the panel portion 152. Arrow 194 illustrates a region where a knockout region 188 has been removed from panel portion 152. The knockout regions 188 have been removed for shelves 104, 106, 108 in FIG. 3.

The backing wall 120 is easily removable for cleaning as well as easy display reconfiguration.

Preferably, the surfaces of the racking system 100 exposed to and/or come into contact with the displayed product contain anti-microbial additives.

Figure 15:
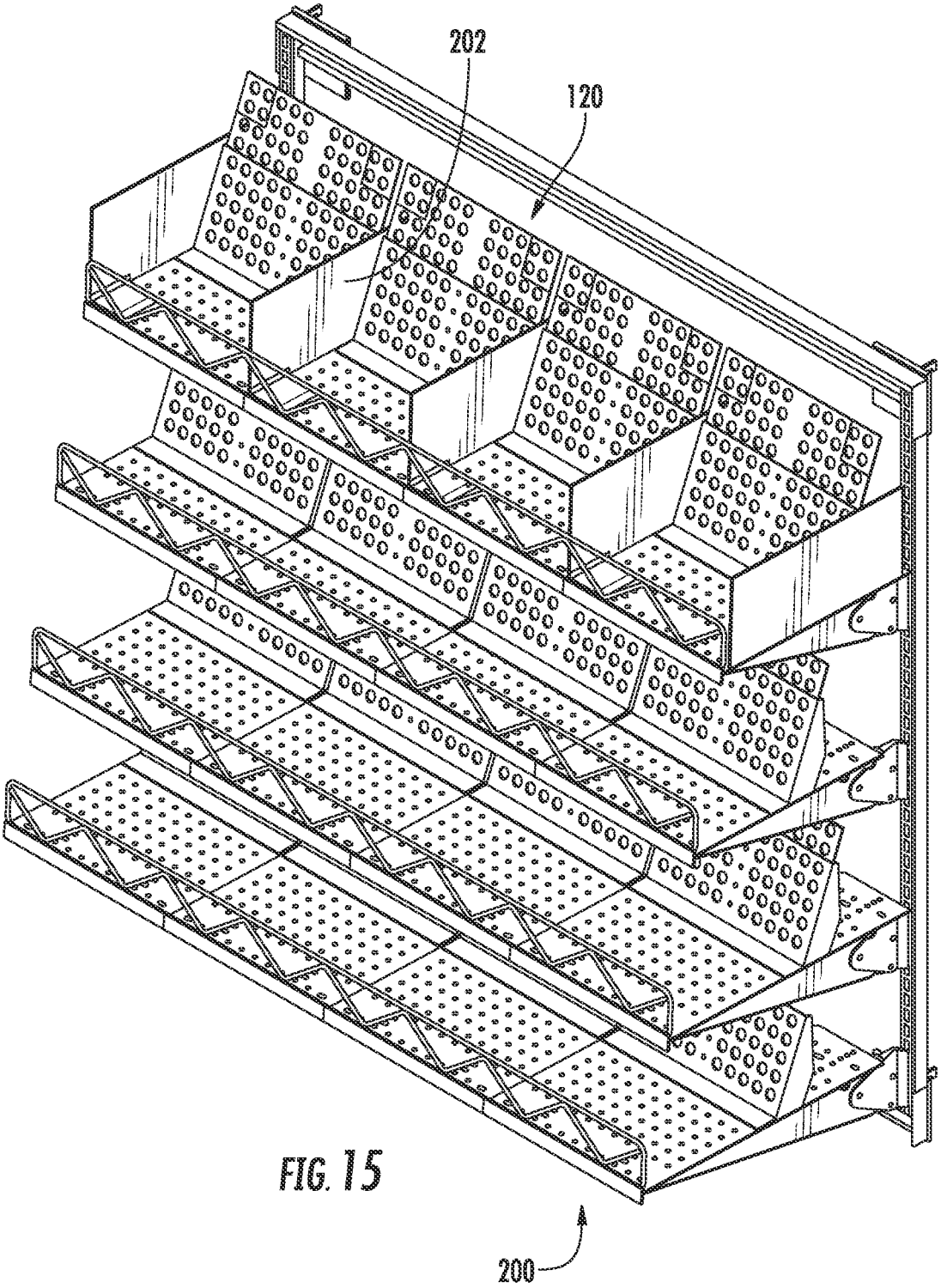
FIG. 15 is a perspective illustration of a further rack system using dividers.

FIG. 15 illustrates a further embodiment of a racking system 200 that is similar in many respects to racking system 100. Only the differences therein will be described. All of the features of racking system 100 described above are equally applicable to racking system 200.

In this embodiment, dividers 202 are provided. The dividers 202 extend forward of the front of the wall portion 122 of the backing wall 120, at least in part. The dividers 202 separate the product display zone 128 forward of the backing wall 120 and rear word of the front 112 of the shelf into separate display zones 128 for a single shelf.

In this embodiment, the dividers 202 have a main divider body 204 that is generally vertically oriented and generally orthogonal to support deck 116. The dividers 202 also include mounting feet 206 that extend laterally outward from the main divider body 204.

Preferably, one mounting foot 206 is positioned in front of the backing wall 120, e.g. proximate a front end 112 of the shelf (see FIG. 16) while a second mounting foot 206 is positioned behind the backing wall 120, e.g. proximate a rear end 114 of the shelf (see FIG. 17).

Figure 18:
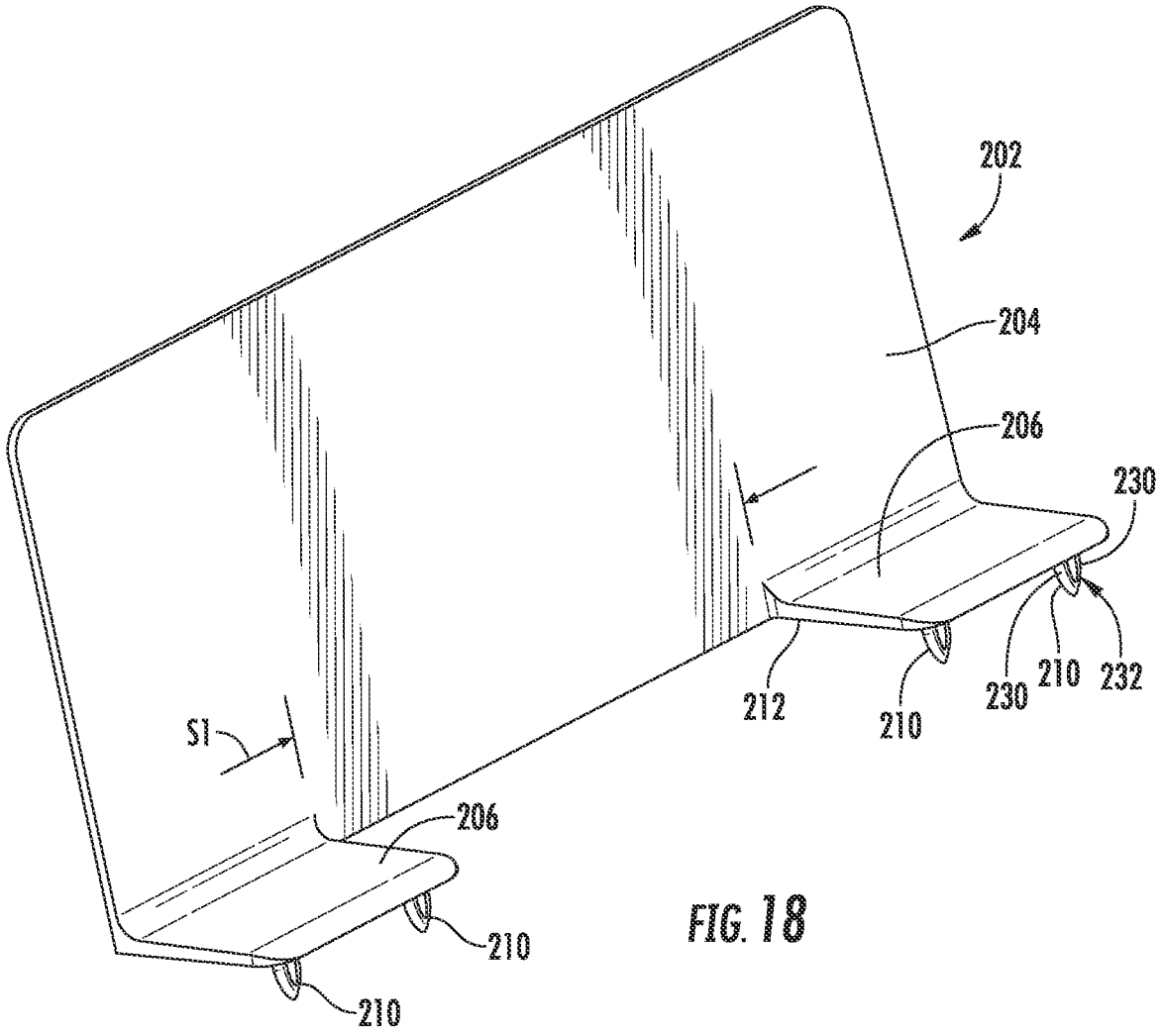
FIG. 18 is a perspective illustration of the dividers used in FIGS. 15-17.

With reference to FIG. 18, the divider 202 preferably includes mounting pins 210 that extend downward from a bottom 212 of the divider 202. The mounting pins 210 extend into apertures 168 in the support deck 116. Preferably, the mounting pins 210 are radially flexible to provide an increased friction fit engagement with the support deck 116 when inserted into apertures 168.

The mounting pins 210 of this embodiment or integrally molded with the rest of divider 202. However, separate push pins could be provided.

Mounting pins 210 have a pair of legs 230 that are separated by a gap 232. The legs 230 are connected at ends thereof. The spacing of legs 230 allows for them to be resiliently biased towards one another when mounting the divider to the support deck 116.

Other mounting or push pins discussed above could have a similar design, e.g. structure 172 of the backing wall 120.

Figure 16:
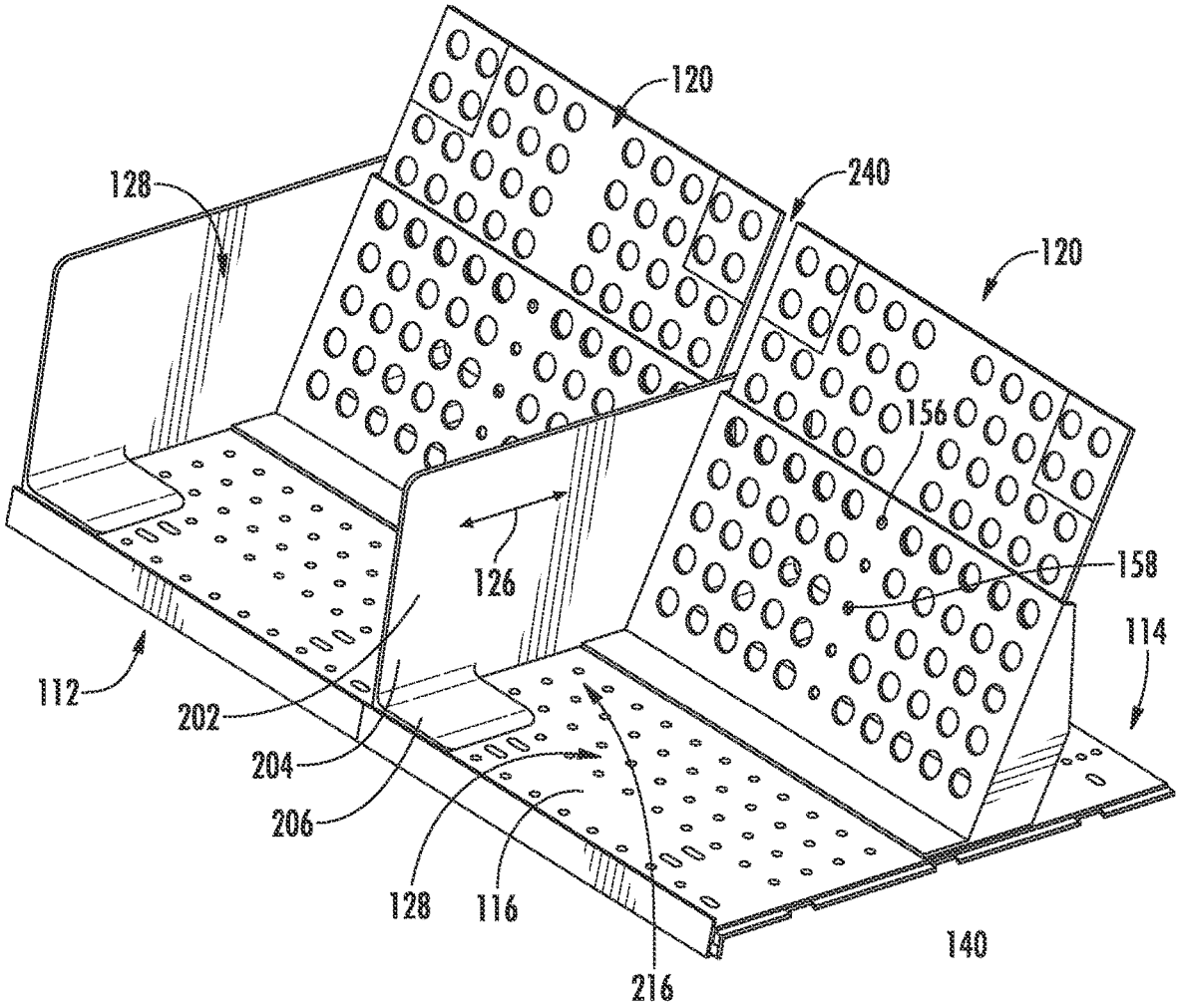
FIG. 16 is a partial enlarged perspective illustration of the rack system of FIG. 15.

Preferably, the spacing S1 between the mounting feet 206 (FIG. 18) is greater than the depth D1 of the base 140 of the backing wall 120 (FIG. 16). With reference to FIG. 6, the difference between spacing S1 and depth D1 provides adjustment region 216 that allows for forward and backward adjustment of the position of backing wall 120 without the feet 206 interfering with mounting of backing wall 120 to support deck 116.

The backing walls 120 have a width that is sufficient to provide a gap 240 through which the main divider body 204 passes. Each backing wall 120 on opposed sides of the divider 202 is independently adjustable in the forward and backward direction (e.g. illustrated by arrow 126).

FIG. 17 illustrates a further feature of panel portion 152. In this panel portion, a pair of slits 153 separate a tab region 157 that carries attachment projection 156 (see FIG. 16). The slights weaken the portion of the panel portion 152 from which the attachment projection 156 projects to allow for easier disengagement and engagement of the attachment projection with apertures 158

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rack system comprising:

a support frame;

a first shelf mounted to the support frame, the first shelf having a first product support deck extending between a front end and a rear end;

a second shelf mounted to the support frame, the second shelf having a second product support deck, the first and second shelves being vertically spaced with the second shelf being vertically above the first shelf; and a backing wall having a wall portion located on the first shelf, the wall portion extending vertically between the first and second shelves, the backing wall being mountable to the first product support deck in a plurality of fixed positions located between the front and rear end of the first product support deck to adjust a spacing between the wall portion and the front end of the first product support deck;

wherein:

the wall portion includes a first panel portion and a second panel portion mounted adjacent the first panel portion, a position of the second panel portion relative to the first panel portion is adjustable to adjust a vertical height of the backing wall;

a product display zone above the product support deck of the first shelf is defined by the front end of the first shelf and the wall portion of the backing wall; and the product display zone is adjustable between first and second fixed sizes by adjusting the position of the wall portion toward or away from the front end of the first shelf between the first and second fixed positions.

2. The rack system of claim 1, wherein:

the backing wall further includes a pair of opposed supports at opposed ends of the wall portion, the opposed supports maintaining the wall portion in an upright orientation relative to the first product support deck; and the opposed supports have a bottom surface, the bottom surface of the supports extending at a non-zero, non-perpendicular angle relative to a front face of the wall portion.

3. A rack system comprising:

a support frame;

a first shelf mounted to the support frame, the first shelf having a first product support deck extending between a front end and a rear end;

a second shelf mounted to the support frame, the second shelf having a second product support deck, the first and second shelves being vertically spaced with the second shelf being vertically above the first shelf; and a backing wall having a wall portion located on the first shelf, the wall portion extending vertically between the first and second shelves, the backing wall being mountable to the first product support deck in a plurality of fixed positions located between the front and rear end of the first product support deck to adjust a spacing between the wall portion and the front end of the first product support deck;

wherein:

the wall portion includes a first panel portion and a second panel portion mounted adjacent the first panel portion, a position of the second panel portion relative to the first panel portion is adjustable to adjust a vertical height of the backing wall;

the backing wall further includes a pair of opposed supports at opposed ends of the wall portion, the opposed supports maintaining the wall portion in an upright orientation relative to the first product support deck; and the opposed supports have a bottom surface, the bottom surface of the supports extending at a non-zero, non-perpendicular angle relative to a front face of the wall portion.

4. The rack system of claim 3, wherein:

the first product support deck includes a first aperture and a second aperture, the first aperture being spaced a different distance from the front end of the first product support deck such that the first aperture defines a first fixed position of the plurality of fixed positions and the second aperture defines a second fixed position of the plurality of fixed positions;

the backing wall includes a first mounting portion, the first mounting portion extending into the first aperture when the backing wall is mounted in the first fixed position and extending into the second aperture when the backing wall is mounted in the second fixed position.

5. The rack system of claim 4, wherein the first mounting portion is a mounting hook.

6. The rack system of claim 4, wherein the first mounting portion is an alignment post.

7. The rack system of claim 4, wherein:

the backing wall includes a front lip positioned forward of the wall portion; and the first mounting portion extending downward from a bottom surface of the front lip.

8. The rack system of claim 4, wherein:

the first mounting portion is a mounting hook that has a downward extending portion and a horizontal extending portion;

the downward extending portion extending through the first aperture in the first fixed position with the horizontal extending portion extending under the first product support deck.

9. The rack system of claim 8 wherein:

the backing wall further includes a downward extending alignment post that extends generally parallel to the downward extending portion of the mounting hook;

the first product support deck includes a second aperture formed therein, the alignment post extending through the second aperture in the first product support deck.

10. The rack system of claim 8, wherein the mounting hook is configured such that the horizontal extending portion extends through the first aperture when mounting the backing wall to the first product support deck and then the backing wall is pivoted relative to the first product support deck as the downward extending portion is positioned within the first aperture, the pivoting action positioning the horizontal extending portion at least partially offset from the aperture.

11. The rack system of claim 4, wherein:

insertion of the first mounting portion within the first aperture prevents movement of the backing wall towards or away from the front end of the first product support deck; and insertion of the first mounting portion within the second aperture inhibits movement of the backing wall towards or away from the front end of the first product support deck.

12. The rack system of claim 3, wherein:

the wall portion of the backing wall includes an array of apertures formed therethrough;

the array of apertures is formed from a first portion of apertures laterally offset from a second portion of apertures;

the wall portion having a column of second apertures positioned between the first and second portions;

the apertures of the array of apertures having a first diameter;

the apertures of the column of second apertures having a second diameter different than the first diameter.

13. The rack system of claim 12, wherein:

the first panel portion including the column of second apertures; and the second panel portion including at least one positioning stud sized to be received in the apertures of the column of second apertures to adjust the positioning of the second panel portion relative to the first panel portion to adjust the vertical height of the backing wall.

14. The rack system of claim 12, wherein:

the first panel portion including a column of mounting apertures;

the second panel portion including at least one positioning stud sized to be received in the apertures of the column of mounting apertures to adjust the positioning of the second panel portion relative to the first panel portion to adjust the vertical height of the backing wall.

15. The rack system of claim 3, wherein:

a product display zone above the product support deck of the first shelf is defined by the front end of the first shelf and the wall portion of the backing wall;

the product display zone is adjustable between first and second fixed sizes by adjusting the position of the wall portion toward or away from the front end of the first shelf between the first and second fixed positions.

16. A method of assembling a rack system of claim 3, comprising:

attaching the first shelf to the support frame, the first shelf having the first product support deck extending between the front end and the rear end;

attaching the second shelf to the support frame, the second shelf having the second product support deck, the first and second shelves being vertically spaced with the second shelf being vertically above the first shelf; and positioning the backing wall between the first and second shelves in one of the plurality of fixed positions between the front and rear ends of the first product support deck, the backing wall having the wall portion, the wall portion extending vertically between the first and second shelves, the backing wall being adjustably positionable between the plurality of fixed positions to adjust a spacing between the wall portion and the front end of the first product support deck.

17. The method of claim 16, wherein:

the backing wall is mountable to the first shelf in at least a first fixed position and a second fixed position, the first fixed position locating the wall portion closer to the front end than the second position such that a smaller amount of the first support deck is exposed forward of the wall portion in the first position than in the second position; and positioning the backing wall includes mounting the backing wall in the first position.

* * * * *